US010667973B2

(12) United States Patent
Bidoki

(10) Patent No.: US 10,667,973 B2
(45) Date of Patent: Jun. 2, 2020

(54) MULTI-PURPOSE SYSTEM FOR A HOSPITAL BED

(71) Applicant: Seyed Mehran Bidoki, Yazd (IR)

(72) Inventor: Seyed Mehran Bidoki, Yazd (IR)

( * ) Notice: Subject to any disclaimer, the term of this patent is extended or adjusted under 35 U.S.C. 154(b) by 265 days.

(21) Appl. No.: 15/615,961

(22) Filed: Jun. 7, 2017

(65) Prior Publication Data

US 2017/0333273 A1 Nov. 23, 2017

Related U.S. Application Data

(60) Provisional application No. 62/356,933, filed on Jun. 30, 2016.

(51) Int. Cl.

| | |
|---|---|
| ***A61G 7/057*** | (2006.01) |
| ***A61G 7/10*** | (2006.01) |
| ***A61G 7/05*** | (2006.01) |

(52) U.S. Cl.

CPC ..... *A61G 7/05707* (2013.01); *A61G 7/05* (2013.01); *A61G 7/05776* (2013.01); *A61G 7/05784* (2016.11); *A61G 7/1019* (2013.01); *A61G 7/057* (2013.01); *A61G 7/05769* (2013.01)

(58) Field of Classification Search

CPC ..... A61G 7/05707; A61G 7/05776; A61G 7/05784; A61G 7/05; A61G 7/1019; A61G 7/057; A61G 7/05769; A61G 7/1026–1036; A47C 23/068

USPC ..... 5/934, 236.1–245

See application file for complete search history.

(56) References Cited

U.S. PATENT DOCUMENTS

| | | | | |
|---|---|---|---|---|
| 3,593,351 A * | 7/1971 | Dove | A61G 7/1019 5/88.1 |
| 3,945,063 A * | 3/1976 | Matsuura | A61G 1/00 5/611 |
| 5,109,558 A * | 5/1992 | Di Blasi | A61G 7/0573 5/236.1 |
| 5,704,083 A * | 1/1998 | Nerg | A61G 7/0005 5/600 |
| 7,191,479 B1 | 3/2007 | Cheng | |

(Continued)

FOREIGN PATENT DOCUMENTS

| | | |
|---|---|---|
| CN | 203303156 U | 11/2013 |
| EP | 2965738 A1 | 1/2016 |

OTHER PUBLICATIONS

Karen L. Cooper, Evidence-Based Prevention of Pressure Ulcers in the Intensive Care Unit, Critical care nurse, 2013, vol. 33, Issue 6, pp. 57-66.

(Continued)

*Primary Examiner* — Peter M. Cuomo
*Assistant Examiner* — Myles A Throop
(74) *Attorney, Agent, or Firm* — Bajwa IP Law Firm; Haris Zaheer Bajwa

(57) ABSTRACT

A multi-purpose system for a bed includes a number of vertically movable lifting members that are parallel and spaced-apart elongated parts transversally connected to the bed. Furthermore, a mattress assembly that has spaced-apart transversal accommodating spaces thereon that are sized to receive the corresponding movable lifting members therein, and an actuating mechanism coupled with the movable lifting members to vertically move the lifting members between a lowered position and a raised position.

17 Claims, 21 Drawing Sheets

(56) References Cited

U.S. PATENT DOCUMENTS

| | | | | |
|---|---|---|---|---|
| 7,818,831 | B2 * | 10/2010 | Mahdjoubi | A61G 7/05769 5/613 |
| 8,646,132 | B2 | 2/2014 | Nguyen | |
| 9,370,250 | B2 | 6/2016 | Ead | |
| 9,955,795 | B2 * | 5/2018 | Krenik | A47C 23/06 |
| 2011/0088164 | A1 * | 4/2011 | Mahdjoubi | A61G 7/05769 5/81.1 R |

OTHER PUBLICATIONS

Elizabeth McInnes, Support surfaces for pressure ulcer prevention, Cochrane Database of Systematic Reviews 2011, Issue 4. Art. No. CD001735.

Courtney H. Lyder, Pressure ulcer prevention and management. Jama, 2003, vol. 289, issue 2, pp. 223-226.

* cited by examiner

MULTI-PURPOSE SYSTEM FOR A HOSPITAL BED

CROSS REFERENCE TO RELATED APPLICATION

This application claims the benefit of priority from U.S. Provisional Patent Application Ser. No. 62/356,933, filed on Jun. 30, 2016, and entitled "HOSPITAL BED CAPABLE OF CHANGING BED SHEETS WHILE BEING OCCUPIED BY A PATIENT," which is incorporated herein by reference in its entirety.

TECHNICAL FIELD

The present disclosure generally relates to systems and apparatuses associated with beds, and particularly to a multi-purpose system for a hospital bed capable of changing the bed sheets while the bed is occupied and providing access to areas of interest under the patient's body.

BACKGROUND

Hardships of moving bedridden patients with low cognitive level in surgical wards and intensive care units or elderly care houses causes a compromise in the ideal number of times that a patient should be bathed or a patient's bed sheet should be changed. In conventional existing hospital beds, the patient must be moved before changing bed sheets. In many cases patients cannot leave the bed without the aid of others. This adds to the duties and difficulties of the patients' families and hospital staff, and more importantly, it may cause pain and discomfort to the patients. Changing bed sheets in a hospital or healthcare facility promotes cleanliness and prevents unnecessary infections, ulcers, injuries, etc. Changing a bed sheet while the patient is still on the hospital bed carries significant challenges, both for the patient, and the care-giver.

In conventional sheet changing methods, a patient on the old sheets is initially rotated on one side such as the left side, then a portion of the old sheets on the right side of the bed, which becomes accessible is folded, and then, new sheets are spread on the right side of the bed. After that, the patient is rotated to the right, over the spread portion of the new sheets, then the old sheets are removed, the remaining folded portion of the new sheets is spread, and finally the patient is positioned in the center of the bed. In this sheet changing method, the patient has to be moved and rotated, which may be uncomfortable or dangerous for a patient and burdensome for the care-taker.

Accordingly, there is a need in the art, for bed sheet changing methods and devices that can efficiently and hygienically change the sheets on a bed while keeping the sheets taut against the bed. There is also a need in the art for a compact and easy to use apparatus for changing bed sheets that can be used with both disposable and non-disposable sheets.

SUMMARY

This summary is intended to provide an overview of the subject matter of this disclosure, and is not intended to identify essential elements or key elements of the subject matter, nor is it intended to be used to determine the scope of the claimed implementations. The proper scope of this disclosure may be ascertained from the claims set forth below in view of the detailed description below and the drawings.

In an exemplary embodiment consistent with the present disclosure, a multi-purpose system for a bed is disclosed. The system may include a number of vertically movable lifting members that are parallel and spaced-apart elongated parts transversally connected to the bed, a mattress assembly that has spaced-apart transversal accommodating spaces thereon sized to receive the corresponding movable lifting members therein, and an actuating mechanism coupled with the movable lifting members to vertically move the lifting members between a lowered position and a raised position.

In an exemplary embodiment, at least one movable lifting member may include a horizontal elongated part supported on parallel legs at one or either ends thereof and the parallel legs may pass through corresponding holes on either sides of the bed. The legs may be connected to the actuating mechanism.

According to an exemplary embodiment, the horizontal elongated part may include a horizontal tube-like part that has a first series of perforations in fluid communication with a first longitudinal channel provided in the tube-like part. The first longitudinal channel may be connected to a pressurized air source in order to provide pressurized air injection through the first series of perforations.

According to an exemplary embodiment, the horizontal elongated part may include a horizontal tube-like part that has a second series of perforations in fluid communication with a second longitudinal channel provided in the tube-like part. The second longitudinal channel may be connected to a vacuum source in order to provide suction through the second series of perforations.

According to an exemplary embodiment, the horizontal elongated part may include inflatable elongated compartments on either sides thereof. The elongated compartments may run along the sides of the horizontal elongated part and may also be in fluid communication with a pressurized air source. The inflatable elongated compartments may be filled with pressurized air to fill the gap between the lifting members in the raised position.

According to an exemplary embodiment, the horizontal elongated part may include elongated plates on either sides thereof. The elongated plates may run along the sides of the horizontal elongated part and they may also be hinged to the sides of the horizontal elongated part.

According to an exemplary embodiment, the elongated plates may pivot about the hinges from a substantially vertical position to a substantially horizontal position on either sides of the lifting member to fill a gap between lifting members in the raised position.

According to an exemplary embodiment, the lifting members in the raised position may be positioned above the mattress with a gap provided between the mattress and the lifting members. According to an exemplary embodiment, the lifting members in the lowered position may fill the accommodating spaces on the mattress.

According to an exemplary embodiment, the spaced-apart transversal accommodating spaces on the mattress may include parallel grooves provided on the mattress. The lifting members in the lowered position may fill the grooves on the mattress.

According to an exemplary embodiment, the mattress assembly may include parallel and spaced-apart elongated mattress members transversally mounted on the bed. The spaces between the mattress members may provide the spaced-apart transversal accommodating spaces sized to receive the corresponding movable lifting members therein. The lifting members in the lowered position may fill the spaces between the mattress members.

According to an exemplary embodiment, at least one mattress member may include a flexible upper portion providing a support surface for the person occupying the bed and a lower rigid portion attached to the bed.

According to an exemplary embodiment, at least one mattress member may include a flexible tube in fluid communication with a fluid source and the pressure of the fluid in the flexible tube may be regulated.

According to an exemplary embodiment, the lifting members may be individually movable between the lowered position and the raised position. According to an exemplary embodiment, the lifting members may have locking mechanisms configured to lock the lifting members in a position selected from the group consisting of the lowered position and the upper position.

According to an exemplary embodiment, the actuating mechanism may include: a movable frame, and a linear actuator coupled with the movable frame thereby actuating a vertical movement of the movable frame along the normal axis of the bed. The movable lifting members may rest upon the movable frame at either sides of the bed.

Other systems, methods, features and advantages of the exemplary embodiments will be, or will become, apparent to one of ordinary skill in the art upon examination of the following figures and the accompanying detailed description. It is intended that all such additional systems, methods, features and advantages be included within this description and this summary, be within the scope of the consistent with exemplary embodiments of the present disclosure, and be protected by the following claims.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The present disclosure is directed to a multi-purpose system that may be used in connection with a hospital bed. The multi-purpose system may allow for performing different tasks without disturbing the patient occupying the bed. These different tasks may include, but are not limited to, changing the bed sheets, toileting, bathing, immobility-related disease prevention procedures, treatment procedures, physical observation, and remedial procedures.

The disclosed system may include a mattress assembly for supporting the patient's body and a lifting assembly for lifting the patient's body from the mattress to provide a gap between the patient's body and the mattress. The mattress assembly may be a one-piece mattress that has a number of transverse grooves thereon or alternatively the mattress assembly may include a number of mattress members that are transversally mounted on the base structure of the bed with transverse spaces therebetween. The lifting assembly may include a number of lifting members that may run from one side of the bed to the other and they may be placed inside the transversal grooves in case of a one-piece mattress or alternatively inside the transversal spaces between the mattress members. The lifting members may be raised up from a lowered position (i.e., between the grooves or spaces in the mattress assembly) to a raised position where a gap is provided between a patient's body and a mattress in order to allow for performing tasks, such as changing the bed sheet under the patient. The lifting members may provide a comfortable supporting surface for the patient in the raised position. The lifting members may be raised or lowered either all together, individually, or in groups. Benefits from individual or in groups raising or lowering the lifting members may include but are not limited to providing a potential caregiver direct access to any preferred area of the patient's body for toileting or bathing the patient. For example, for placing a pad or a pan under a patient. Alternatively, it may allow for performing treatment and remedial procedures or physical observation on a certain area of the patient's body without the need for moving, rotating, or disturbing the patient.

Figure 1A:
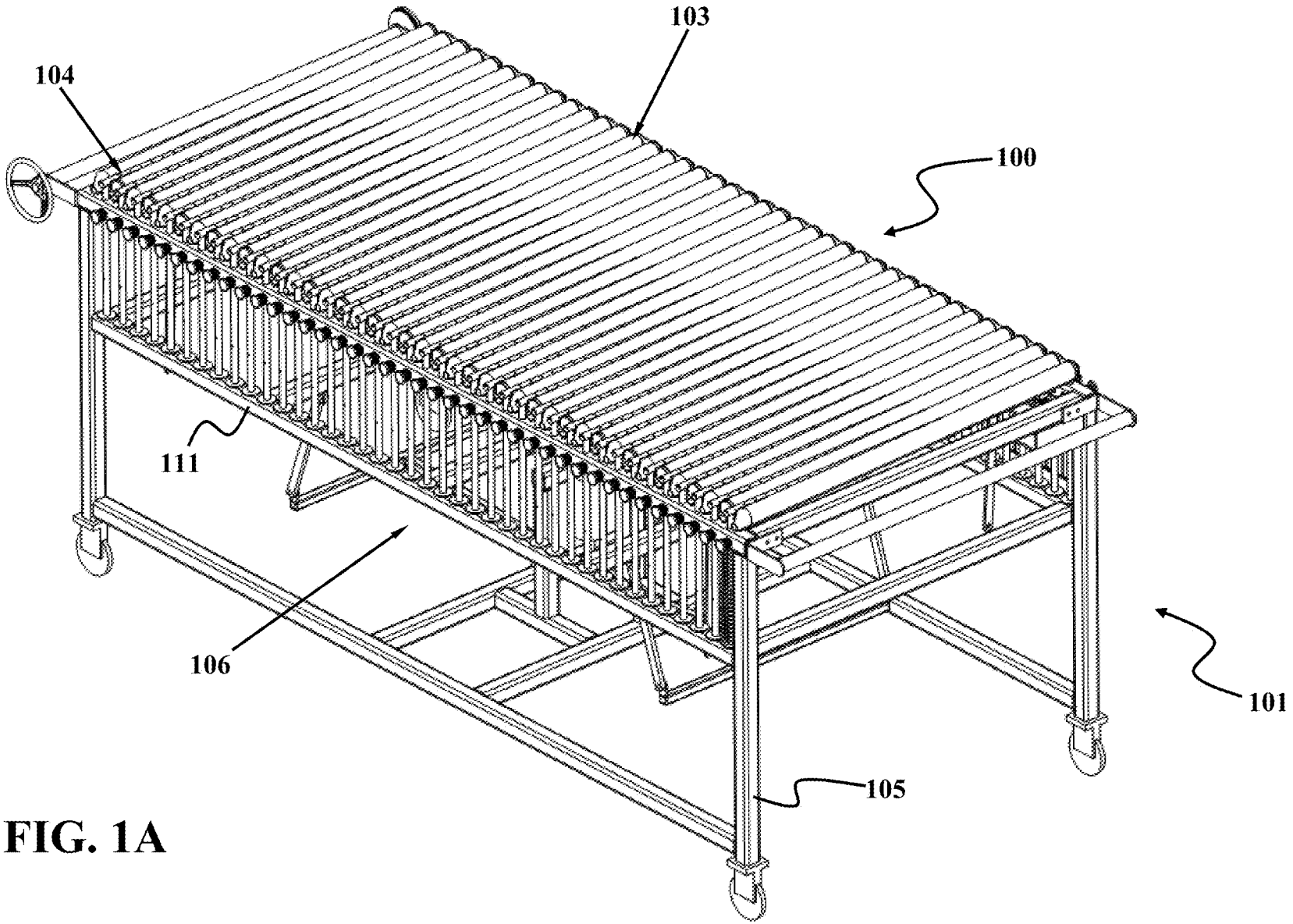
FIG. 1A illustrates a perspective view of a multipurpose system for a hospital bed, consistent with an exemplary embodiment of the present disclosure.

FIG. 1A illustrates a multi-purpose system 100 that is mounted on a bed structure 101, consistent with an exemplary embodiment of the present disclosure. The system 100 may include a mattress assembly 103 and a lifting assembly 104. The mattress assembly 103 may be mounted on a base structure 105 of the bed. Additionally, the lifting assembly 104 may be mounted on a lifting mechanism 106 that may be connected to the base structure 105 of the bed.

Figure 1B:
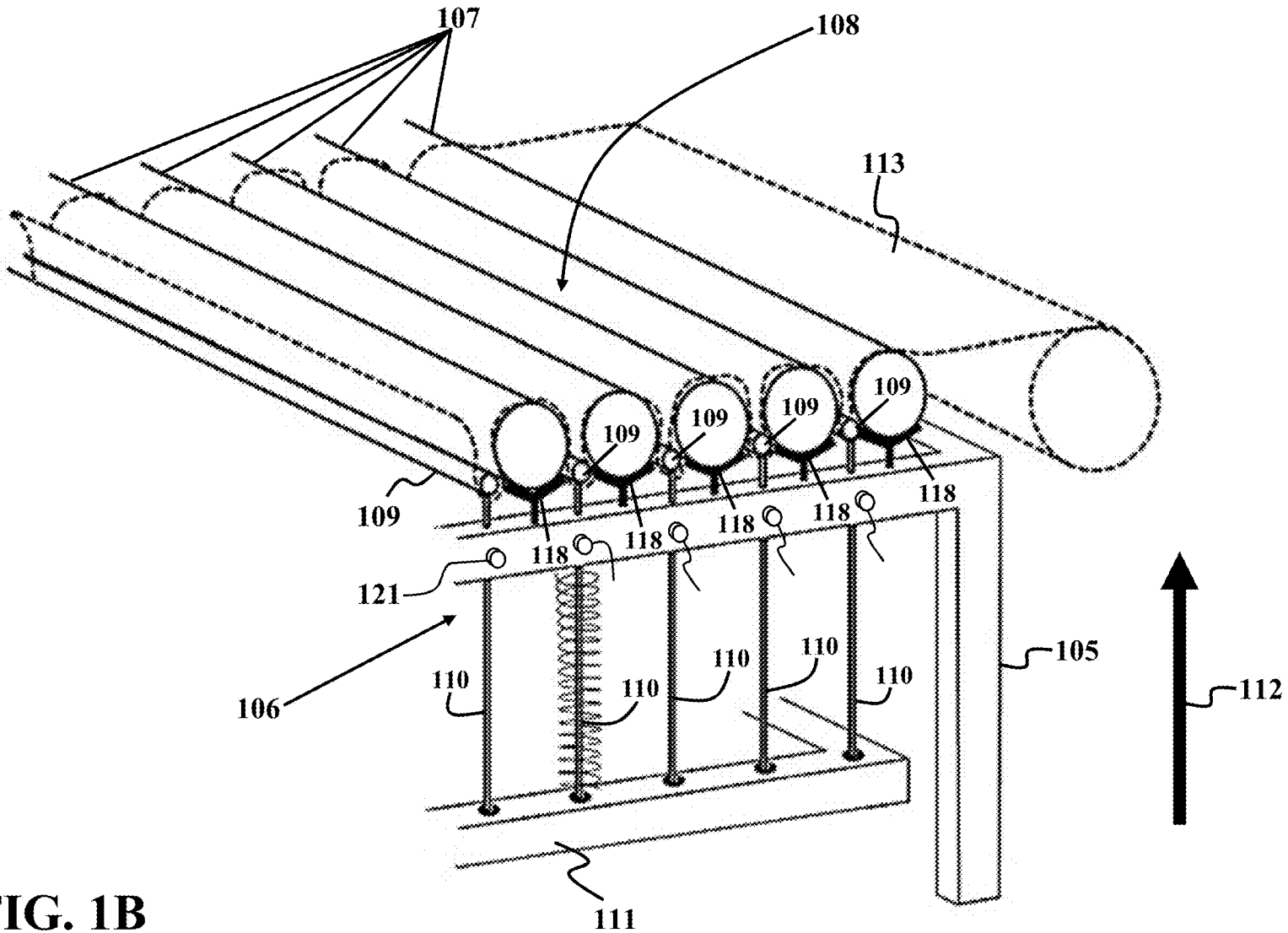
FIG. 1B is a schematic representation of a multipurpose system for a hospital bed, consistent with an exemplary embodiment of the present disclosure.

Referring to FIG. 1B, in an exemplary embodiment the mattress assembly 103 may include a number of mattress members 107. The mattress members 107 may be transversally mounted on the base structure 105 of the bed. In an exemplary embodiment, the mattress members 107 may be spaced-apart, tube-like members that may provide a flexible and comfortable supporting surface 108 for a patient's body. In an exemplary embodiment, the mattress members 107 may have a circular or non-circular profile from a side view (not shown in FIG. 1B).

With further reference to FIG. 1B, the lifting assembly 104 may include a number of lifting members 109 that transversally run from one side of the bed to the other side. Each lifting member may be accommodated in between two mattress members. A lifting member 109 may be a rod-shaped member supported on two parallel legs 110 at either sides of the bed (one side is obscured from view in FIG. 1B). Each leg may be connected to a movable frame 111 that allows for moving the lifting member 109 in a vertical direction shown by arrow 112. Alternatively, each leg 110 may be separately connected to a hydraulic or pneumatic mechanism for individually moving each lifting member 109 in a vertical direction shown by arrow 112.

Figure 4:
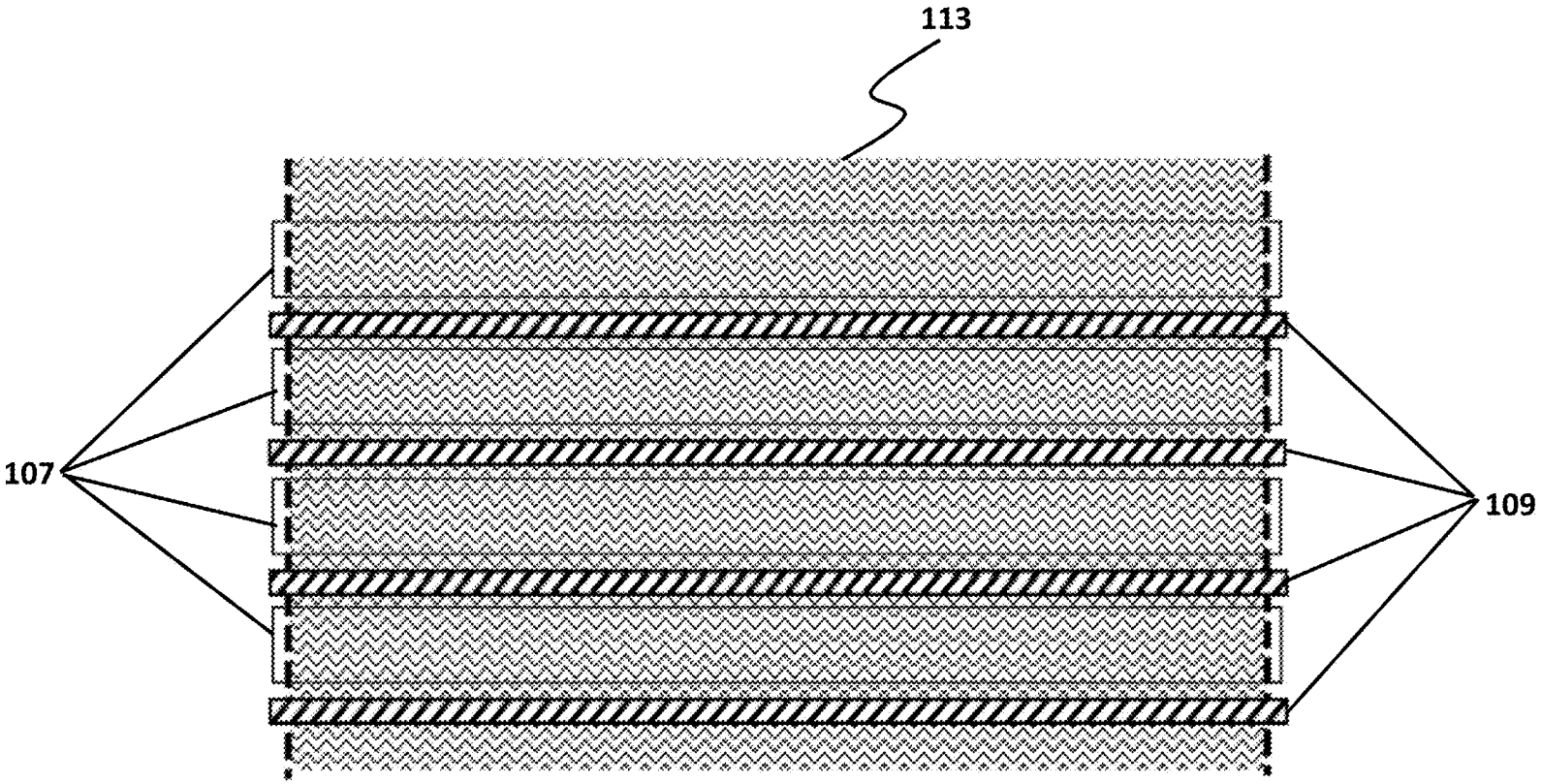
FIG. 4 illustrates a top-view schematic representation of a mattress assembly and a lifting assembly, consistent with an exemplary embodiment of the present disclosure.

Referring to FIGS. 1B and 4, a bed sheet 113 may be spread over the mattress members 107 and under the lifting members 109. The lifting members 109 may be raised form a lowered position in between the mattress members 107 to a raised position. In the lowered position, the bed sheet 113 is spread over the mattress members 107 and tucked in the spaces between the mattress members 107 by the lifting members 109. In the raised position, the bed sheet 113 may be pulled from under the lifting members 109 in order to be changed and washed.

Figure 1C:
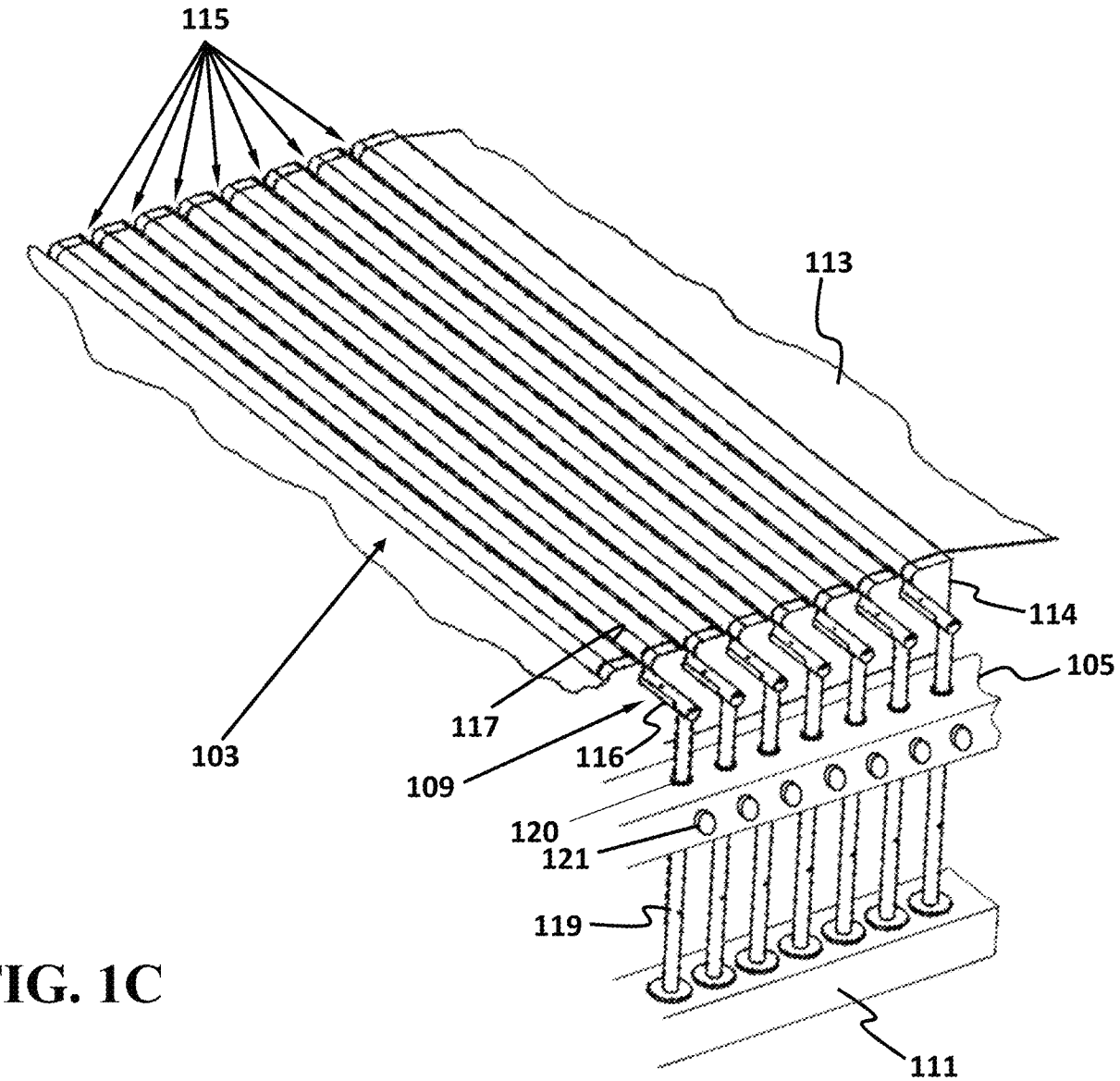
FIG. 1C is a schematic representation of a multipurpose system for a hospital bed, consistent with an exemplary embodiment of the present disclosure.

Referring to FIG. 1C, in another exemplary embodiment, the mattress assembly 103 may be a one-piece mattress 114 that has a number of transversal grooves 115 thereon. Each lifting member 104 may be accommodated in a corresponding groove on the mattress 114. For example, lifting member 116 may be accommodated in the groove 117 on the mattress. Referring to FIG. 1C, bed sheet 113 may be spread over the one-piece mattress 114 and under the lifting members 109. The lifting members 109 may be raised form a lowered position in between the grooves 115 to a raised position. In the lowered position, the bed sheet 113 is spread over the one-piece mattress 114 and tucked in the grooves 115 on the mattress by the lifting members 109. In the raised position, the bed sheet 113 may be pulled from under the lifting members 109 in order to be changed and washed.

Figure 2A:
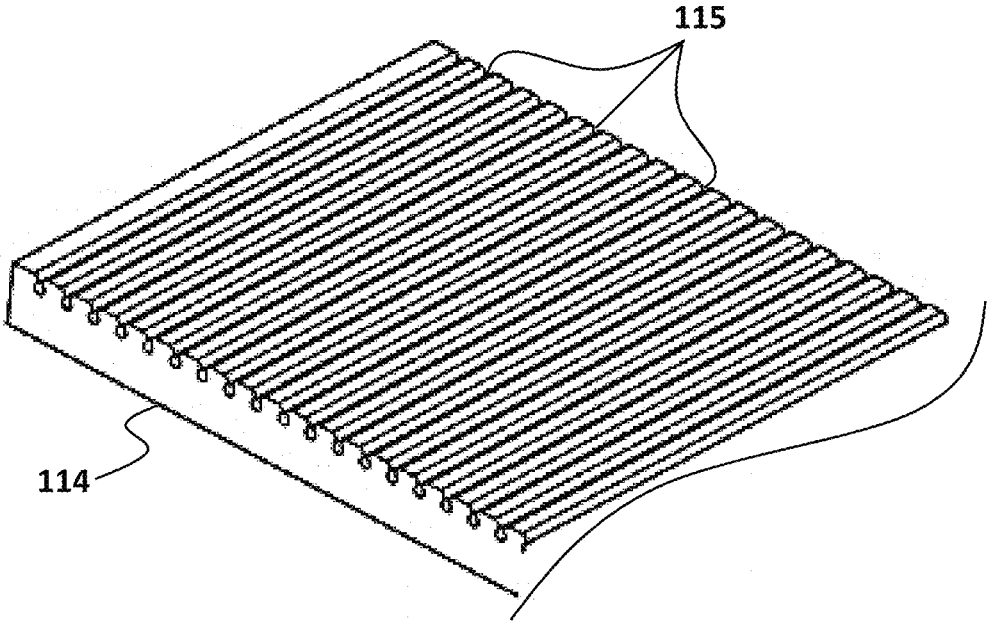
FIG. 2A illustrates a perspective and a left view of a mattress assembly with transversal grooves thereon, consistent with an exemplary embodiment of the present disclosure.
Figure 2A:
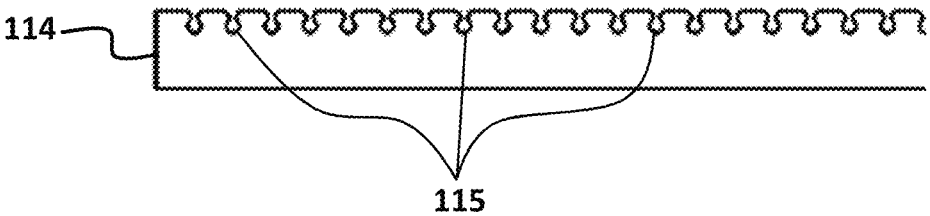

FIG. 2A shows a perspective and a left-side view of an exemplary one-piece mattress 114. One-piece mattress 114 may include transversal grooves 115 that run from one side of the mattress 114 to the other. The grooves 115 may be sized to receive or fit a corresponding lifting member therein, while providing a comfortable support surface 201 for the patient.

Figure 2B:
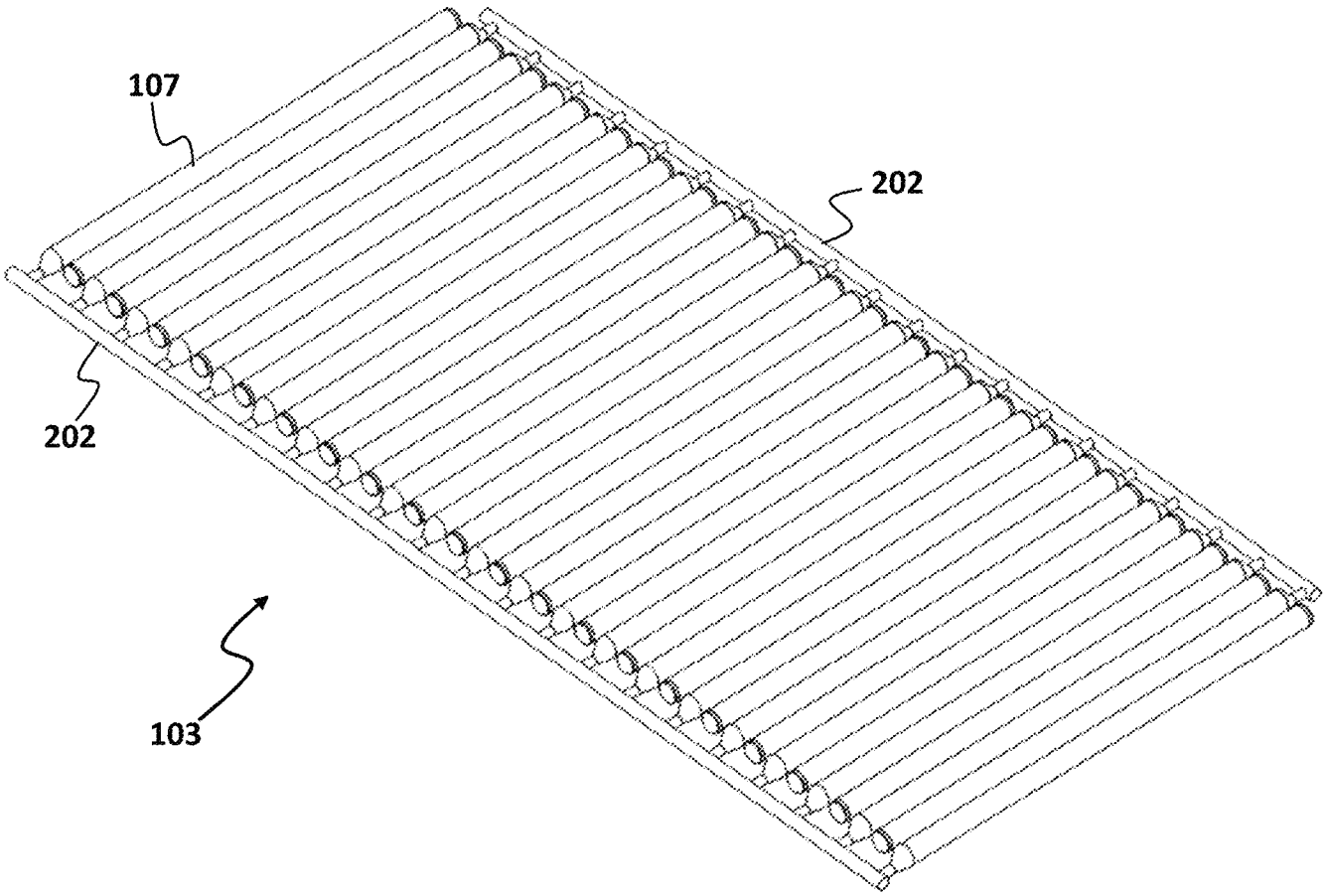
FIG. 2B illustrates a perspective view of a mattress that has a number of transversal elongated mattress members, consistent with an exemplary embodiment of the present disclosure.

FIG. 2B shows an exemplary mattress assembly 103 that has a number of mattress members 107. Mattress members 107 may be a series of equally spaced apart flexible tubes in fluid communication with a hydraulic or pneumatic system via fluid tubes 202 in order to regulate the pressure of the fluid inside the mattress members 107. This feature may allow the mattress assembly 103 to function as an alternating pressure relief mattress for avoiding bed sores from formation. In an implementation, a mattress member may be independently in fluid communication with a fluid tube. Alternatively, the mattress members may be interconnected fluidically and the fluid provided by a fluid tube that may flow in mattress members.

Referring to FIG. 1B, a mattress member 107 may be supported on a support structure 118 connected to the base structure 105. According to an exemplary embodiment, mattress member 107 may be a flexible member supported on the rigid support structure 118. Alternatively, mattress member 107 may be a rigid member covered on top with a flexible material in order to provide a comfortable support surface for the patient.

Figure 3B:
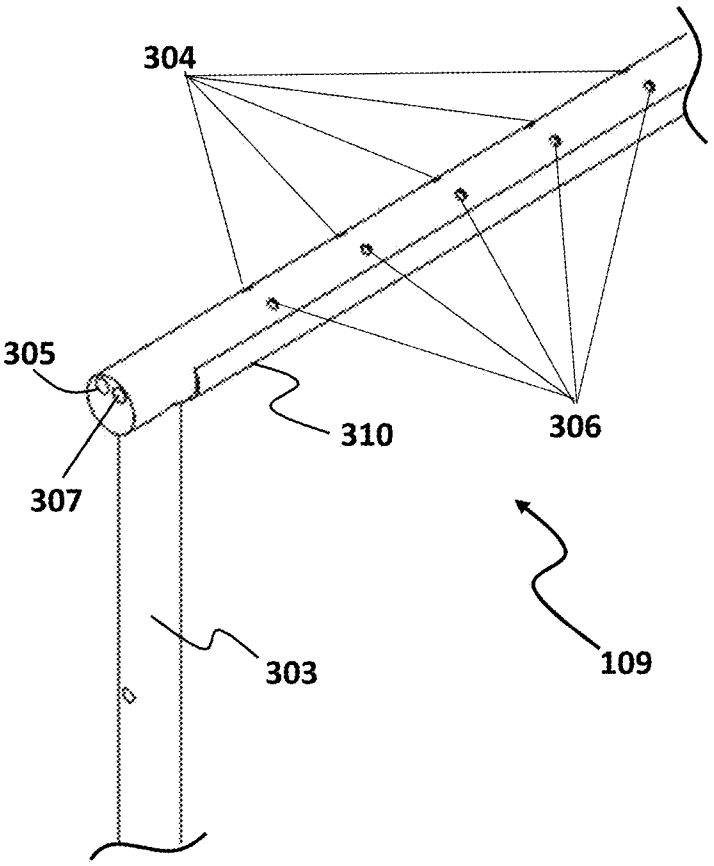
FIGS. 3A and 3B illustrate a lifting member, consistent with an exemplary embodiment of the present disclosure.
Figure 3A:
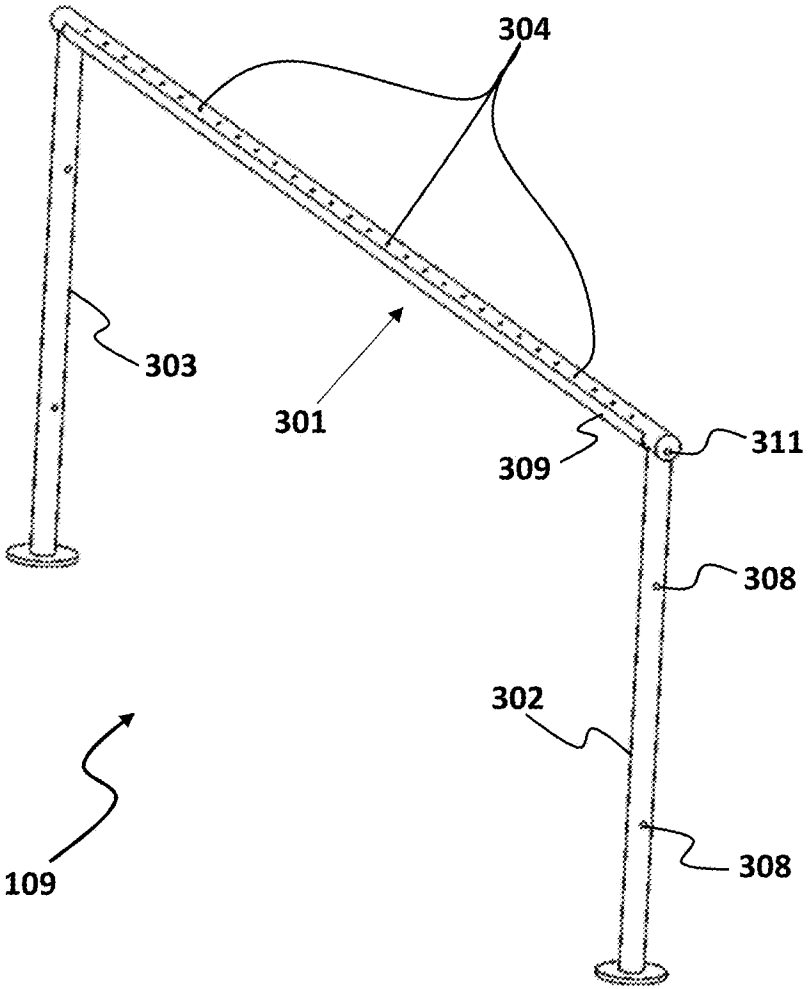

FIGS. 3A and 3B illustrate an exemplary lifting member 109. The lifting member 109 may include a horizontal tube-like lifting part 301 that may be supported on two legs 302 and 303 at either sides of the bed structure. The lifting member 109 may have a number of perforations, for example, perforations 304 thereon that may be in fluid communication with a pressurized air source via channel 305. Therefore, air injection may be provided through perforations 304. The lifting member 109 may further have a number of perforations, for example, perforations 306 thereon that may be in fluid communication with a vacuum pump via channel 307. Therefore, air suction may be provided through perforations 306. Benefits from this feature may include, but is not limited to, circulating air between the mattress assembly and the person's body, avoiding the risk of water vapor or temperature accumulation under the patient's body and lowering the risk of bed sores, and allowing a patient to be in a physically comfortable condition.

Referring to FIGS. 1A-1C and FIG. 3A, according to exemplary embodiment, a lifting assembly, for example, lifting assembly 104 may be mounted or placed/rested upon movable frame 111. Legs of a lifting member may slide through corresponding holes on either sides of the bed structure 105 or may be placed/rest upon the movable frame 111. For example, referring to FIG. 1C, leg 119 of lifting member 116 may slide through corresponding hole 120 on base structure 105 and rest upon the movable frame 111. The movable frame 111 may be connected to a lifting mechanism that moves the movable frame in a substantially vertical direction.

Referring to FIG. 3A, a leg of a lifting member 109, for example, leg 302 may have a number of holes 308 thereon to which locking pins may be positioned. Referring to FIGS. 1B and 1C, the base structure 105 may have a corresponding hole thereon through which a locking pin, for example, locking pin 121 may slide making a locking mechanism set which may then go into the corresponding holes on a leg to lock the vertical movement of a lifting member either in the raised position or the lowered position. Benefits from these features may include but is not limited to, allowing a first lifting member to be individually locked in the raised position while a second lifting member may be lowered into the lowered position.

According to an exemplary embodiment, the multipurpose system may be utilized for changing bed sheets of a bed without disturbing the patient occupying the bed. For this purpose, first a bed sheet may be spread over a mattress that may be either a one-piece mattress with transversal grooves thereon or a mattress that has a number of spaced-apart mattress members, then a plurality of vertically movable lifting members may be placed inside the grooves or the spaces between the mattress members, such that a lifting member that is a transversal rod-shaped member may be placed in a corresponding groove or space on the mattress over the bed sheet, thereby, tucking the bed sheet in the groove or the space between the mattress members. During this process, a patent remains comfortably supported on the mattress. In order to change the bed sheet, lifting members may be moved upward from their lowered position to a raised position in order to lift the patient and create a gap between the patient and the mattress. Then, the bed sheet may be changed and a clean sheet may be spread over the mattress under the raised patient. Finally the lifting members may be moved back downward from their raised position to their lowered position placing the patient on the clean sheet.

Figure 5A:
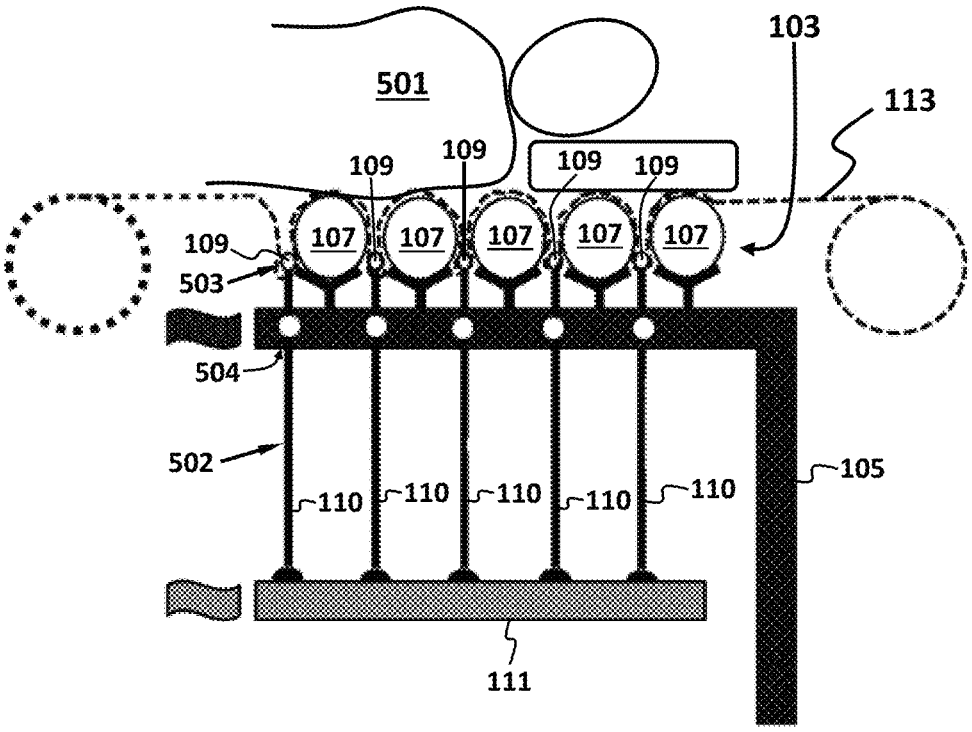
FIGS. 5A-5G illustrate an implementation of a method for changing bed sheets without disturbing a person occupying the bed, consistent with exemplary embodiments of the present disclosure.

FIGS. 5A-5F illustrate an exemplary method for changing the bed sheets without disturbing the patient 501 occupying the bed. Referring to FIG. 5A, the patient's body 501 is supported on the mattress assembly 103 and bed sheet 113 is spread over the mattress members 107, and tucked between the mattress members 107 under lifting members 109. Lifting members 109 in FIG. 5A are in their lowered position (i.e., filling the empty spaces between the mattress members). Legs 110 of the lifting members 109 slide through corresponding holes on the base structure 105 and rest upon movable frame 111. For example leg 502 of lifting member 503 slides through a corresponding hole 504 on the base structure 105 of the bed and rests on the movable frame 111, such that moving the movable frame 111 in a vertical direction will lead to the movement of the lifting member 503 in the same direction.

Figure 5B:
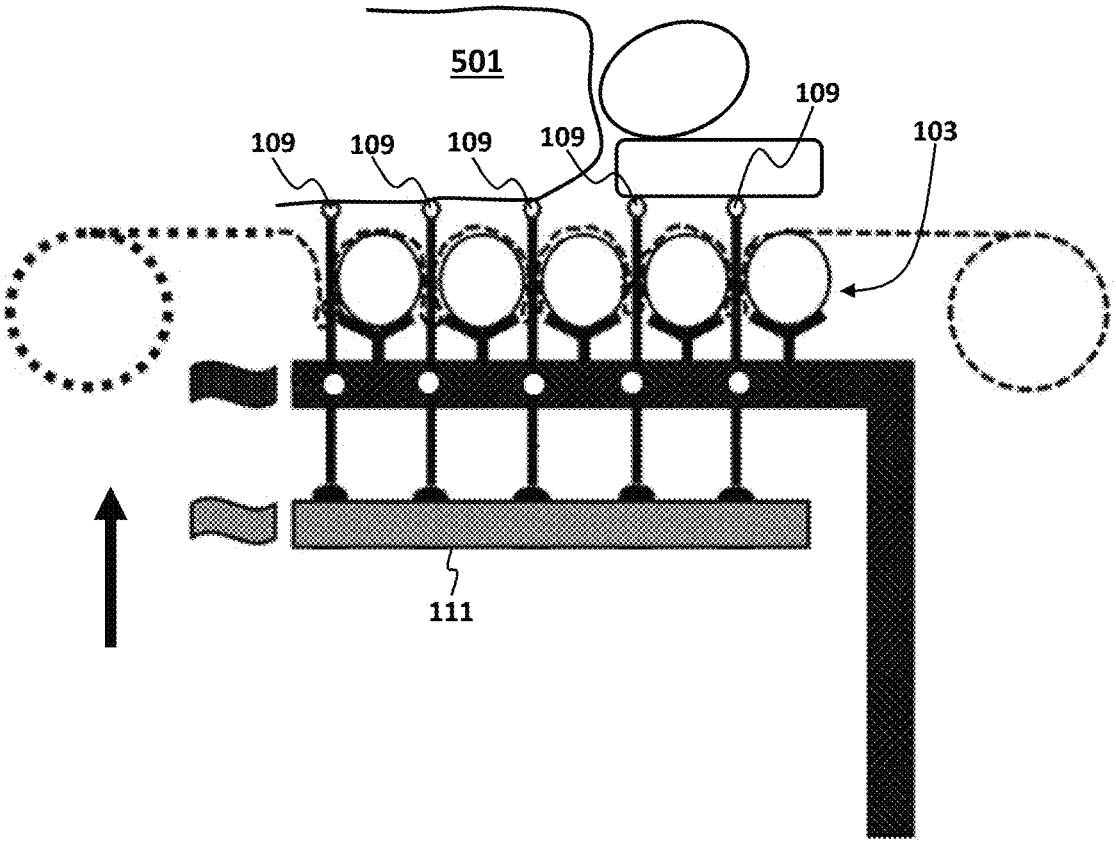

Referring to FIG. 5B, the movable frame 111 may be moved upward in a vertical direction and lifting members 109 will move up from their lowered position to a raised position as shown in this figure. As the lifting members 109 move to their raised position, a gap is created between the patient's body 501 and the mattress assembly 103.

Figure 5C:
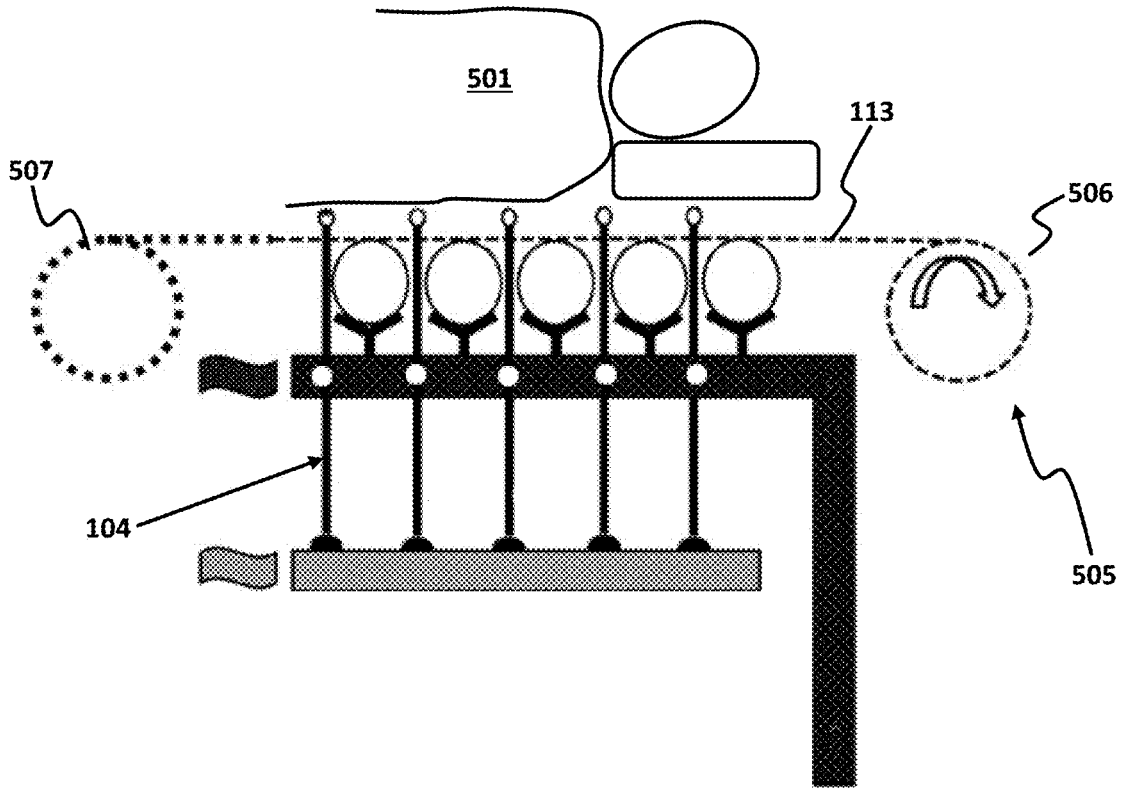

Referring to FIG. 5C, bed sheet 113 may now be pulled from under the patient's body 501. A rolling mechanism 505 may be utilized for rolling and thereby pulling the bed sheet 113 from under the patient 501 or alternatively a caregiver or a hospital staff may carry out this task manually. For example, after lifting the patient 501 by the lifting assembly 104, dirty sheets may be pulled out from under the patient 501 by a caregiver and they may be manually replaced by clean sheets. Alternatively, after lifting the patient 501 by the lifting assembly 104, a dirty sheet roller 506 may roll out the dirty sheet from under the patient 501 and a clean sheet unrolled from a clean sheet roller 507 may replace the dirty sheet.

Figure 5D:
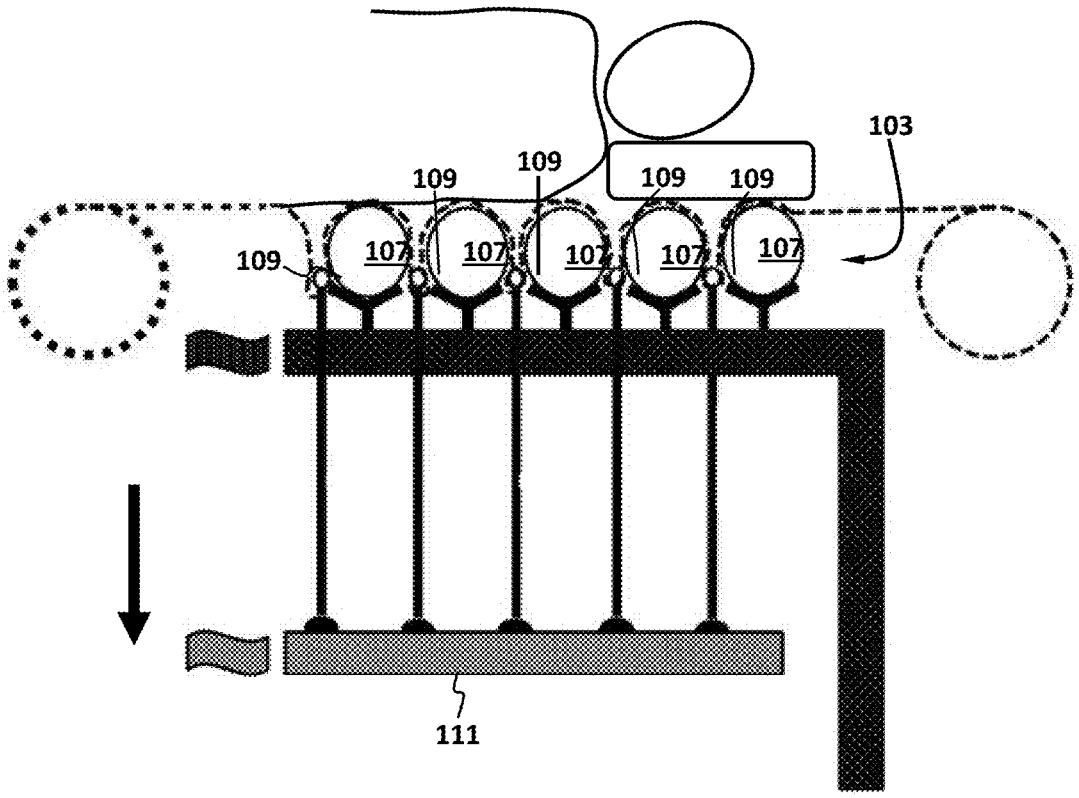

Referring to FIG. 5D, once the clean sheet has been replaced on the mattress assembly 103, the lifting members 109 may be moved downward from their raised position to their lowered position. As the lifting members 109 move down to their lowered position by the movable frame 111, they tuck the clean sheet between the mattress members 107. Alternatively, lifting members 109 may be lowered one by one from one end of the bed to the other as illustrated in FIGS. 5E to 5G.

Figure 5E:
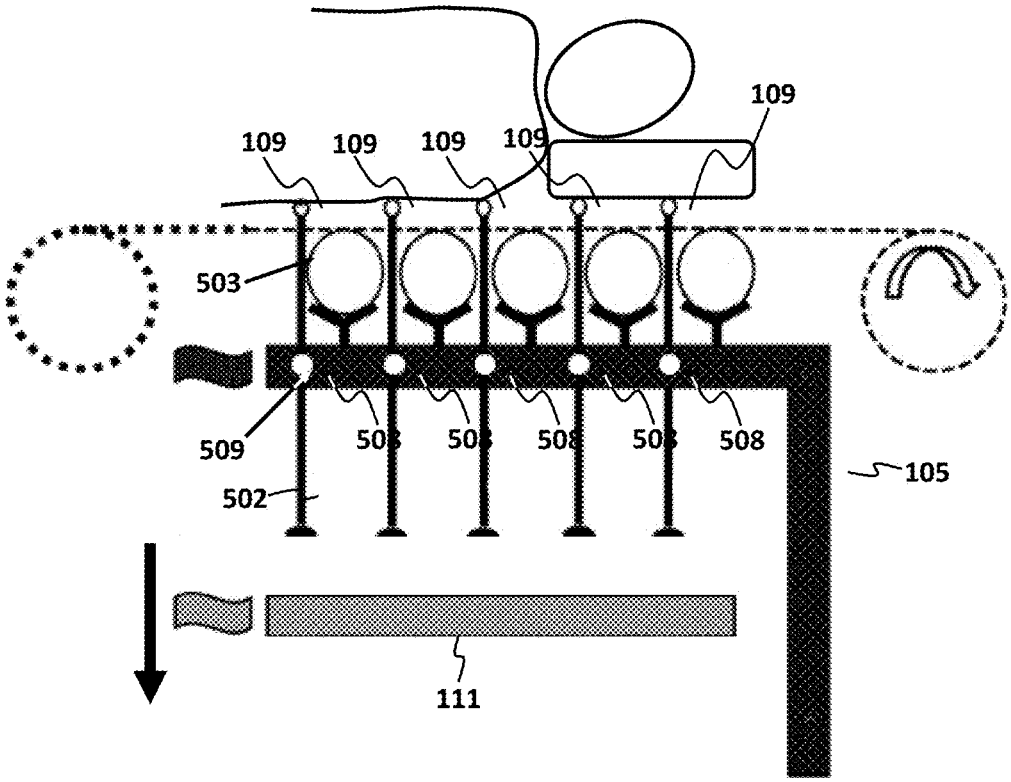
Figure 5F:
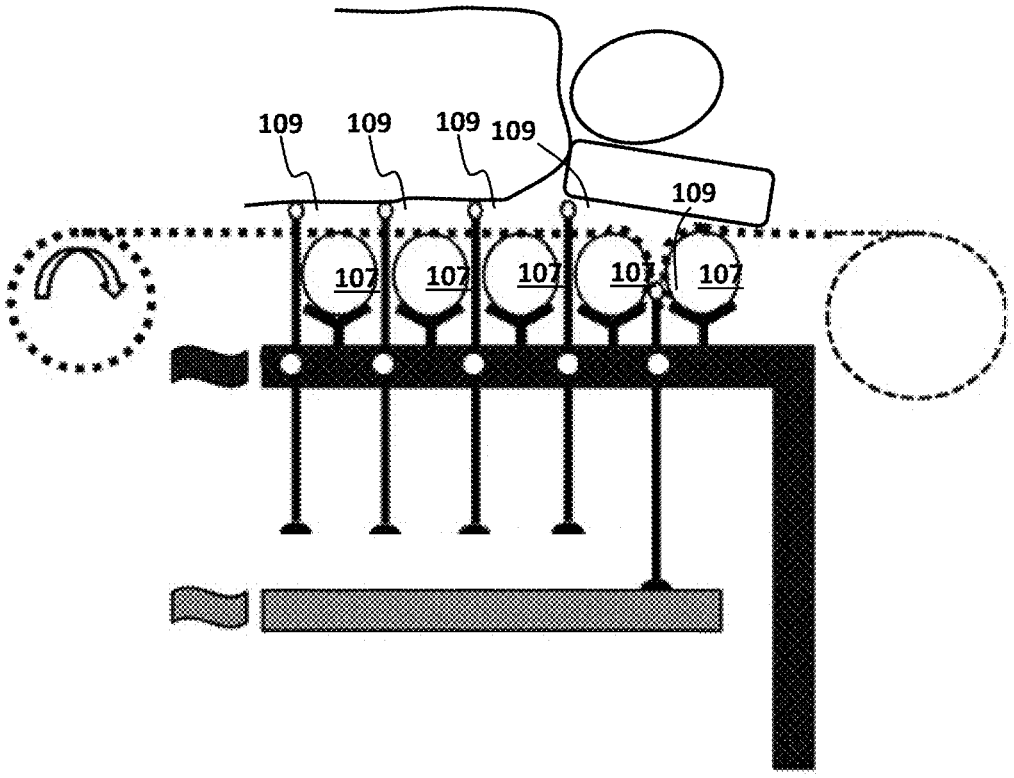
Figure 5G:
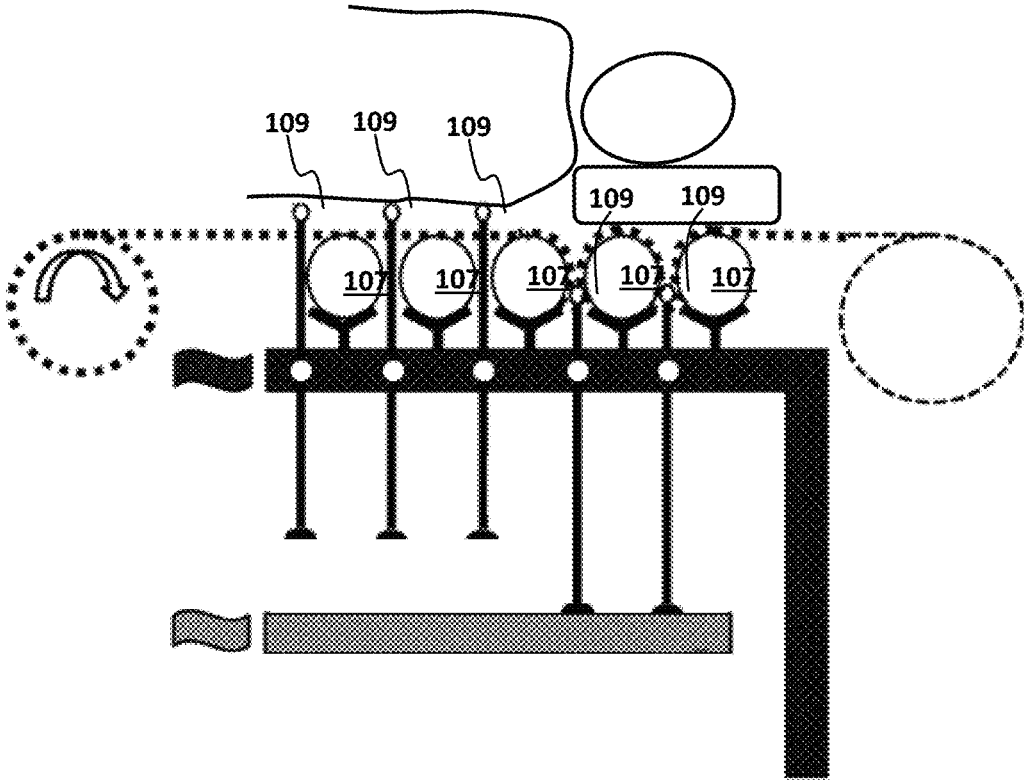

Referring to FIG. 5E, in order to lower the lifting members 109 individually, first the lifting members 109 may be locked in their raised position using their corresponding locking mechanisms 508. For example, lifting member 503 may be locked in its raised position by its corresponding locking mechanism 509. Locking mechanism 509 may be a pin lock that is received in a hole in the base structure 105 and a corresponding hole on leg 502 of the lifting member 503 thereby locking the vertical movement of the lifting member 503. Once the lifting members 109 are locked in their raised position, then the movable frame 111 may be moved down to its initial position. After that, the locking mechanisms 508 of the lifting members 109 may be unlocked one by one from one end of the bed to the other as shown in FIGS. 5F and 5G. As the lifting members 109 are released to move down to their lowered position, they gradually tuck the clean sheet in-between the mattress members 107. Exemplary systems and method allow for the clean sheet to unroll while the clean sheet is being gradually tucked between the mattress members in order to avoid exerting stress or pressure on to the bed sheet which may cause it to tear or damage over time.

According to an exemplary embodiment, the multi-purpose system of the present disclosure may be utilized for providing a caregiver direct access to any preferred area of the patient's body for toileting or bathing the patient. For example, it may allow for placing a pad or a pan under the patient. Alternatively, it may allow for performing treatment and remedial procedures or for physical observations on a certain area of the patient's body without the need for moving, rotating, or disturbing the patient. For this purpose, first a patient may be raised from the mattress by the lifting members and then the lifting members may be locked in their raised position. Then, the lifting members under the area of interest on the patient's body may be unlocked to move back to their lowered position, creating an empty access area under the patient's body for the caregiver to place a pad or a pan under the patient, or for performing treatment and remedial procedures and physical observations on that certain area of the patient's body without the need for moving, rotating, or disturbing the patient.

Figure 6A:
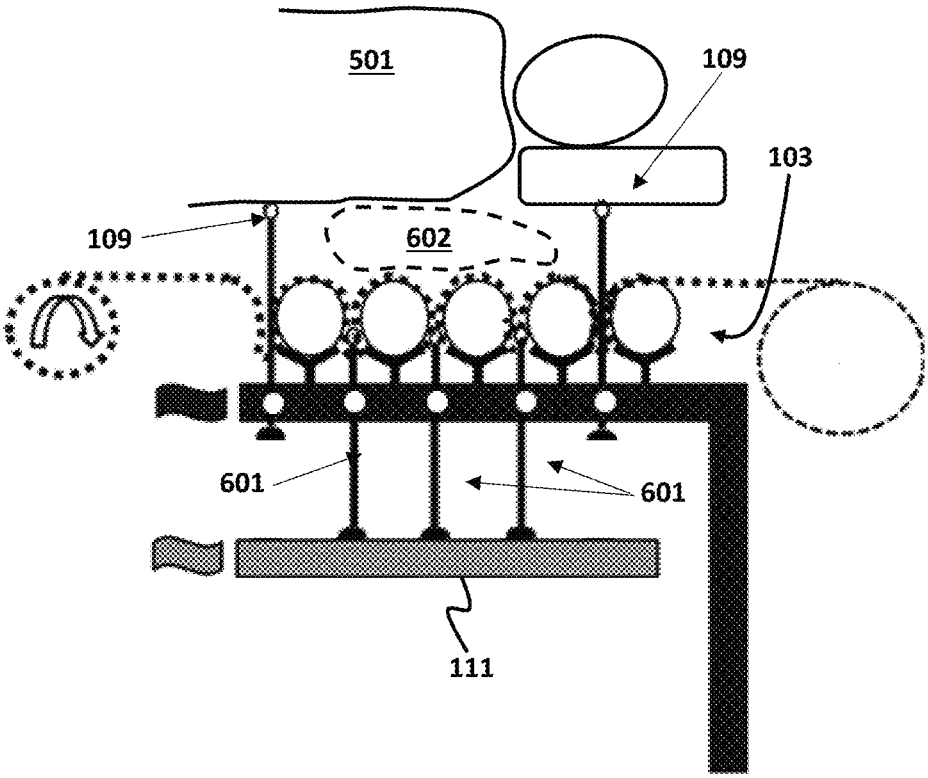
FIGS. 6A-6D illustrate an implementation of a method for providing access to a desired part of the patient's body without disturbing the patient occupying the bed, consistent with exemplary embodiments of the present disclosure.
Figure 6B:
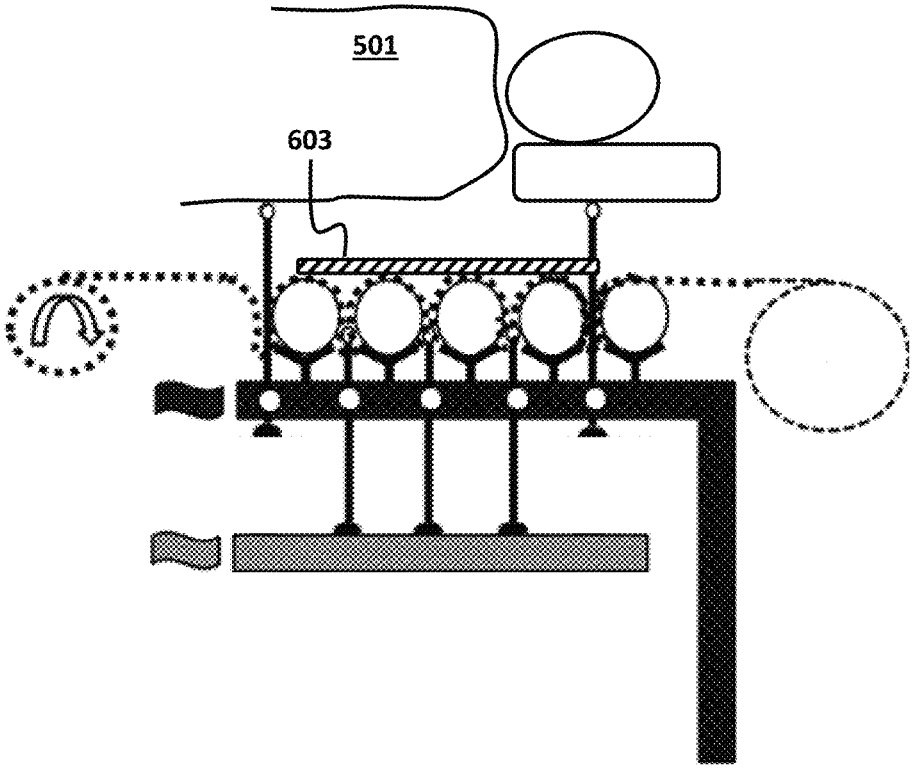
Figure 6C:
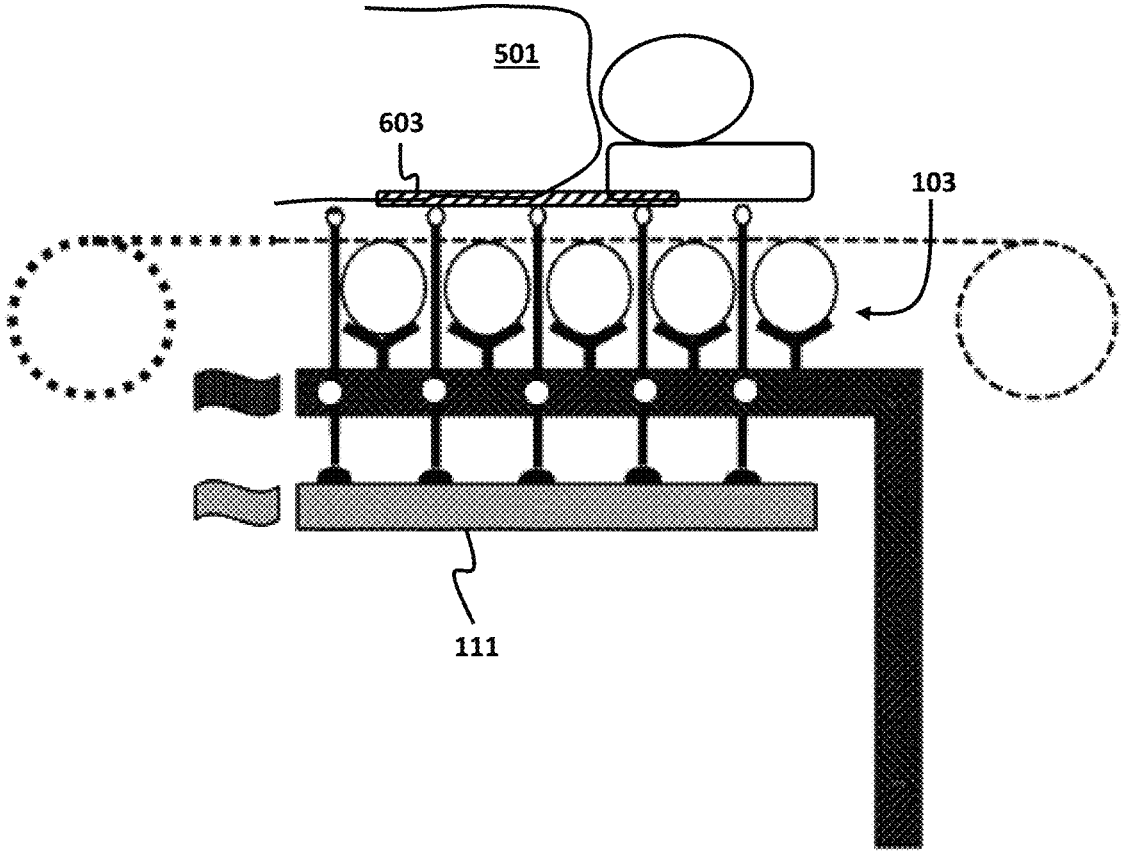
Figure 6D:
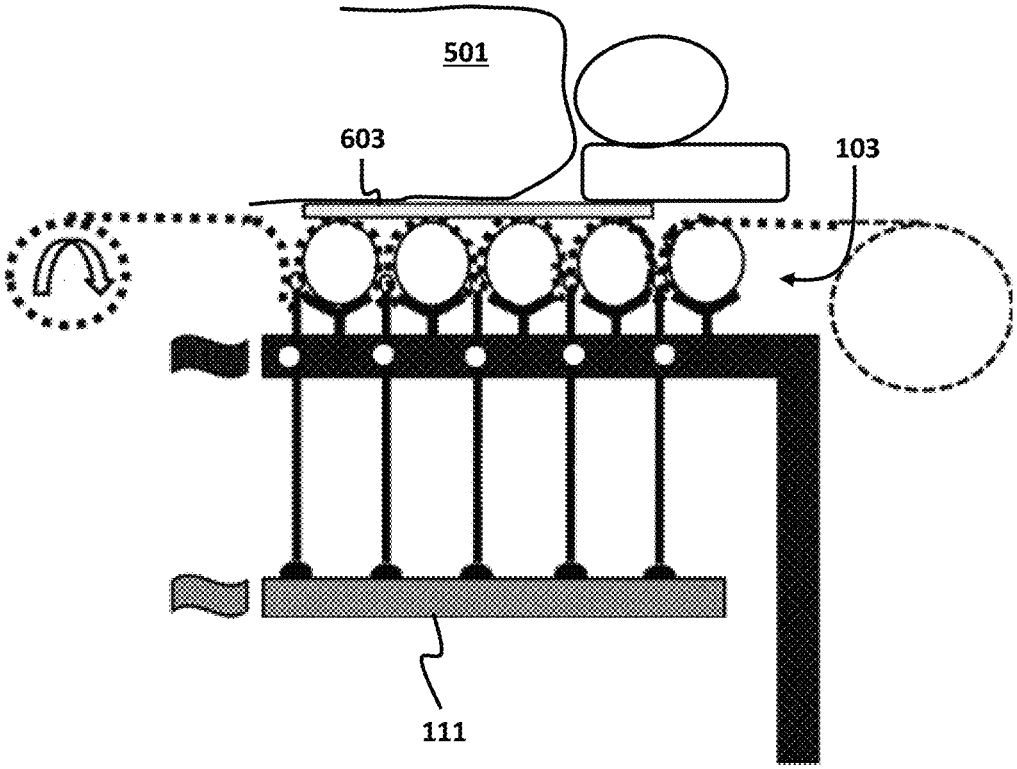

FIGS. 6A to 6D illustrate an exemplary method for utilizing an exemplary multipurpose system for providing access to a certain area under the patient's body 501. First the patient 501 may be raised by the lifting members upwardly away from the mattress assembly 103 as was described in detail in connection with FIGS. 5A and 5B. Then lifting members 109 may be locked in their raised position and the movable frame 111 may be moved downward to its initial position. After that, lifting members under the area of interest on the patient's body, for example lifting members 601, may be unlocked to move down to their lowered position thereby providing an empty access area 602 under the patient's body 501. Referring to FIG. 6B, a pad or pan 603 may be placed under the patient's body 501 under an area of interest on the patient's body 501. Referring to FIG. 6C, once the pad or pan 603 is placed under the patient 501, the movable frame 111 may be moved upward to urge the lifting members 601 up to their raised position, and then all the lifting members 109 are released and lowered by the movable frame 111 to slowly place the patient 501 on the mattress assembly 103 as shown in FIG. 6D. Alternatively, after placing the pad 603 under the patient 501, simply all the other lifting members may be released to move back to their lowered position to place the patient 501 on the mattress 103.

Figure 7A:
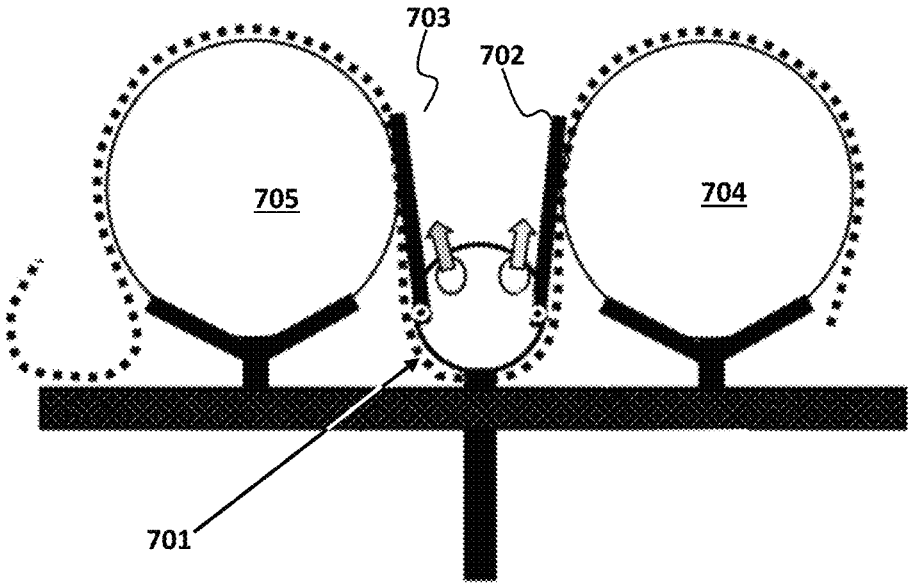
FIGS. 7A and 7B illustrate an exemplary implementation of a lifting member with elongated plates attached to either sides thereof.
Figure 7B:
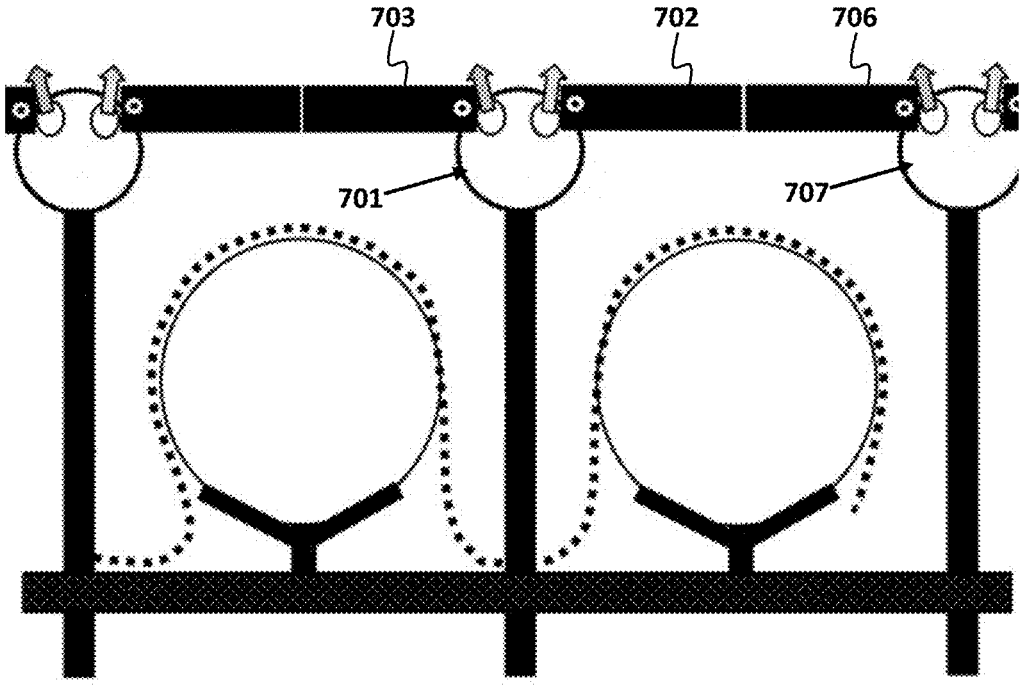

Referring to FIG. 7A, according to an exemplary embodiment, a lifting member 701 may further include two elongated plates 702, 703 attached to either sides of a lifting member 701 by utilizing hinges. In the lowered position of the lifting member 701, as shown in FIG. 7A, the elongated plates 702, 703 may be in their closed position between two mattress assemblies 704 and 705. Referring to FIG. 7B, as the lifting member 701 moves upward to its raised position, the elongated plates 702, 703 pivot about their hinges and open towards the side of the lifting member 701. As shown in FIG. 7B, elongated plate 702 of lifting member 701 and a second elongated plate 706 of a second lifting member 707, may fill the gap between the two lifting members 701 and 707 providing a continuous support surface under the patient.

Referring to FIGS. 3A and 3B, in an exemplary embodiment, lifting member 109 may further include two inflatable compartments 309 and 310 that run along either sides of the lifting part 301. The inflatable compartments 309 and 310 may be in fluid communication with a pressurized fluid source (e.g., pressurized air source) via a longitudinal channel 311 in the lifting part 301. As the lifting member 109 moves to its raised position, the inflatable compartments 309 and 310 may be filled with air via channel 311 thereby filling the gap between the lifting members and providing a continuous and comfortable supporting surface for the patient.

Figure 8:
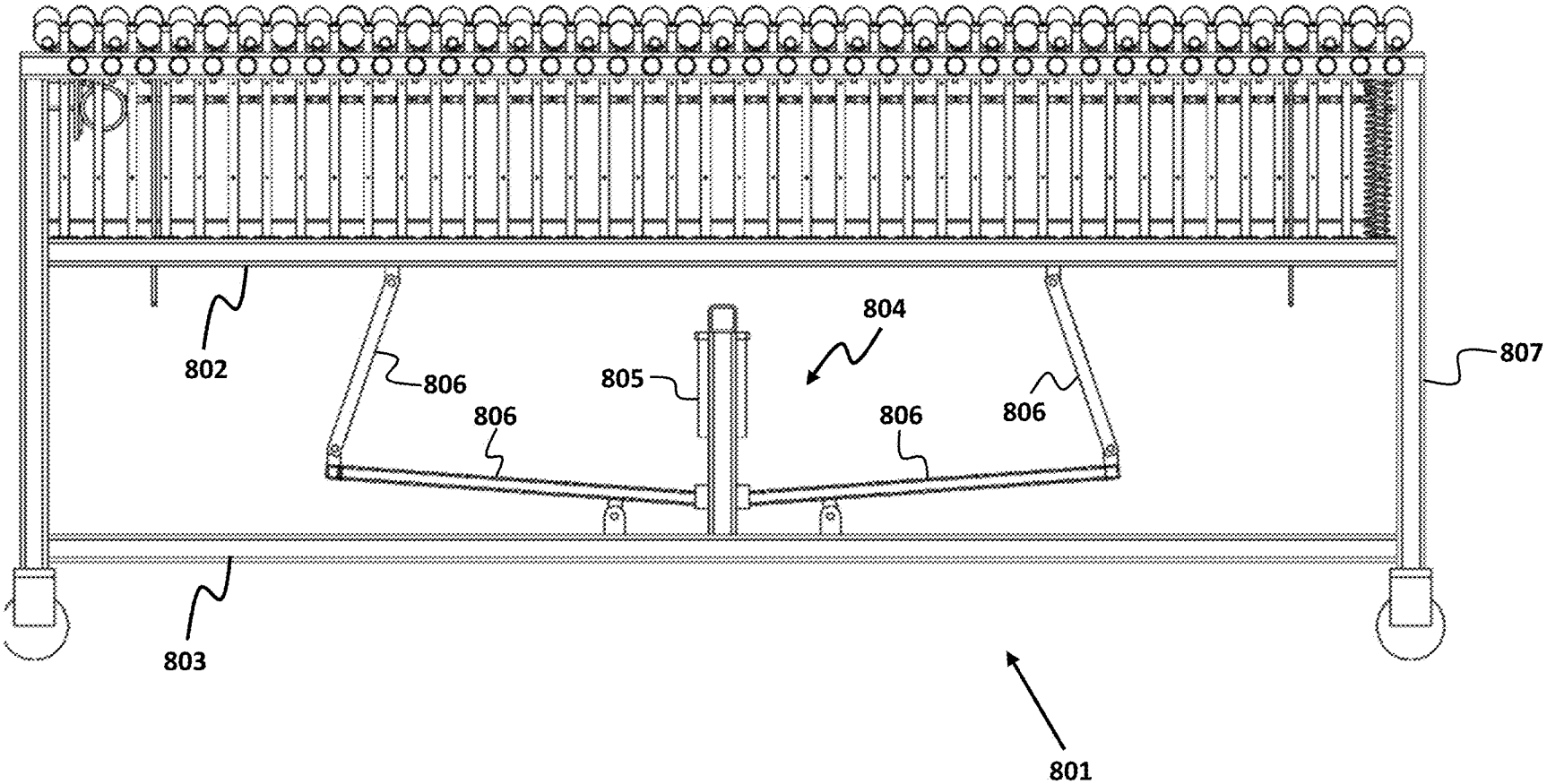
FIG. 8 illustrates a left view of a multipurpose system for a hospital bed, consistent with an exemplary embodiment of the present disclosure.

FIG. 8 illustrates a lifting mechanism 801 that illustrates an exemplary implementation of the lifting mechanism 106 of FIG. 1A. The lifting mechanism 801 may include a movable frame 802, a support frame 803, and an actuating mechanism 804 coupled with the movable frame 802. The actuating mechanism 804 may include a linear actuator 805, such as an electric, a pneumatic or hydraulic jack that may be coupled with the movable frame 802 via a number of links 806. The actuating mechanism 804 may be mounted on the support frame 803 and it may actuate the vertical movement of the movable frame 802. The actuating mechanism 804 may be mounted on the support frame 803. The support frame 803 may be attached to the base frame 807 of the bed.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A multi-purpose system for a bed, the system comprising:

a plurality of vertically movable lifting members that are parallel and spaced-apart elongated parts transversally connected to the bed, wherein at least one movable lifting member comprises a horizontal elongated part supported on parallel legs at either ends thereof, the horizontal elongated part comprises inflatable elongated compartments on either sides thereof, the elongated compartments running along the sides of the horizontal elongated part, the elongated compartments in fluid communication with a pressurized air source;

a one-piece mattress assembly with spaced-apart transversal grooves thereon, each of the respective grooves sized to receive a corresponding lifting member of the movable lifting members therein; and an actuating mechanism coupled with the movable lifting members to vertically move the movable lifting members between a lowered position and a raised position.

2. The multi-purpose system according to claim 1, wherein the parallel legs passing through corresponding holes on either sides of the bed, the legs connected to the actuating mechanism.

3. The multi-purpose system according to claim 2, wherein the horizontal elongated part comprises a horizontal tube with a first series of perforations in fluid communication with a first longitudinal channel provided in the tube, the first longitudinal channel connected to a pressurized air source to provide pressurized air injection through the first series of perforations.

4. The multi-purpose system according to claim 2, wherein the horizontal elongated part comprises a horizontal tube with a second series of perforations in fluid communication with a second longitudinal channel provided in the tube, the second longitudinal channel connected to a vacuum source to provide suction through the second series of perforations.

5. The multi-purpose system according to claim 1, wherein the inflatable elongated compartments are filled with pressurized air to fill the gap between the lifting members in the raised position.

6. A multi-purpose system for a bed, the system comprising:

a plurality of vertically movable lifting members that are parallel and spaced-apart elongated parts transversally connected to the bed;

a mattress assembly with spaced-apart transversal accommodating spaces thereon, each of the respective accommodating spaces sized to receive a corresponding lifting member of the movable lifting members therein; and an actuating mechanism coupled with the movable lifting members to vertically move the movable lifting members between a lowered position and a raised position, wherein, at least one movable lifting member comprising a horizontal elongated part supported on parallel legs at either ends thereof, the parallel legs passing through corresponding holes on either sides of the bed, the legs connected to the actuating mechanism, and wherein the horizontal elongated part includes elongated plates on either sides thereof, wherein the elongated plates run along the sides of the horizontal elongated part, wherein the elongated plates are hinged to the sides of the horizontal elongated part.

7. The multi-purpose system according to claim 6, wherein the elongated plates pivot about the hinges from a substantially vertical position to a substantially horizontal position on either sides of the lifting member to fill the gap between the lifting members in the raised position.

8. The multi-purpose system according to claim 6, wherein the mattress assembly includes parallel and spaced-apart elongated mattress members transversally mounted on the bed, wherein spaces between the mattress members provides the spaced-apart transversal accommodating spaces sized to receive the corresponding movable lifting members therein.

9. The multi-purpose system according to claim 8, wherein the lifting members in the lowered position fill the spaces between the mattress members.

10. The multi-purpose system according to claim 8, wherein at least one mattress member comprises a flexible tube in fluid communication with a fluid source, wherein pressure of the fluid in the flexible tube is regulated.

11. The multi-purpose system according to claim 1, wherein each respective lifting member comprises a respective locking mechanism, the respective locking mechanism configured to individually lock the respective lifting members in the lowered position or the raised position.

12. The multi-purpose system according to claim 1, wherein the actuating mechanism comprises:

a movable frame; and a linear actuator coupled with the movable frame thereby actuating a vertical movement of the movable frame along the normal axis of the bed, wherein the movable lifting members rest upon the movable frame at either sides of the bed.

13. The multi-purpose system according to claim 1, wherein the one-piece mattress assembly comprises a monolithic mattress, the spaced-apart transversal grooves formed on the monolithic mattress.

14. The multi-purpose system according to claim 1, wherein the spaced-apart transversal grooves comprise spaced-apart transversal depressions on the one-piece mattress.

15. The multi-purpose system according to claim 6, wherein the horizontal elongated part comprises a horizontal tube with a first series of perforations in fluid communication with a longitudinal channel provided in the tube-.

16. The multi-purpose system according to claim 15, wherein the longitudinal channel is connected to a vacuum source to provide suction through the second series of perforations.

17. The multi-purpose system according to claim 15, wherein the longitudinal channel is connected to a pressurized source to provide pressurized air injection through the first series of perforations.

* * * * *